US009407042B2

(12) United States Patent
Berry, III

(10) Patent No.: US 9,407,042 B2
(45) Date of Patent: Aug. 2, 2016

(54) ELECTRICAL OUTLET SAFETY DEVICE

(71) Applicant: Henry K. Berry, III, Yorktown, VA (US)

(72) Inventor: Henry K. Berry, III, Yorktown, VA (US)

( * ) Notice: Subject to any disclaimer, the term of this patent is extended or adjusted under 35 U.S.C. 154(b) by 0 days.

(21) Appl. No.: 14/516,967

(22) Filed: Oct. 17, 2014

(65) Prior Publication Data

US 2015/0111411 A1 Apr. 23, 2015

Related U.S. Application Data

(60) Provisional application No. 61/961,828, filed on Oct. 18, 2013.

(51) Int. Cl.

| | |
|---|---|
| ***H01R 13/62*** | (2006.01) |
| ***H01R 13/639*** | (2006.01) |
| ***H01R 24/76*** | (2011.01) |
| *H01R 13/443* | (2006.01) |
| *H01R 103/00* | (2006.01) |

(52) U.S. Cl.

CPC ..... *H01R 13/6395* (2013.01); *H01R 24/76* (2013.01); *H01R 13/443* (2013.01); *H01R 2103/00* (2013.01)

(58) Field of Classification Search

CPC ..... H01R 13/6395; H01R 13/639; H01R 13/6396; H01R 24/76

USPC ..... 439/373, 147, 135

See application file for complete search history.

(56) References Cited

U.S. PATENT DOCUMENTS

| | | | | |
|---|---|---|---|---|
| D151,571 | S | 10/1948 | Tillinghast | |
| 4,083,618 | A * | 4/1978 | Busch, Jr. | H01R 13/6395 439/147 |
| 4,895,527 | A * | 1/1990 | Brown | H01R 13/447 439/147 |
| 6,159,034 | A * | 12/2000 | Royer | H01R 13/6397 439/373 |
| 6,674,003 | B1 | 1/2004 | Torres | |
| 7,371,105 | B1 * | 5/2008 | Allende | H01R 13/6395 439/373 |

* cited by examiner

*Primary Examiner* — Felix O Figueroa
(74) *Attorney, Agent, or Firm* — Nixon & Vanderhye P.C.

(57) ABSTRACT

Electrical outlet safety devices are adapted for positionally capturing a plug head associated with an appliance cord relative to a receptacle of the outlet. The safety device includes a body plate having front and rear sides and opposed lateral edges, the body plate being adapted for removable connection relative to a cover plate associated with the electrical outlet. At least one elongate open-ended blind channel extends from one toward another of the opposed lateral edges. The channel thus defines an opposed pair of parallel edges to sandwich the plug head associated with the electrical appliance between the body plate and the cover plate of the electrical outlet, whereby the plug head is positionally captured relative to the receptacle.

22 Claims, 8 Drawing Sheets

ELECTRICAL OUTLET SAFETY DEVICE

CROSS-REFERENCE TO RELATED APPLICATION

This application is based on and claims domestic priority benefits under 35 USC §119(e) from U.S. Provisional Patent Application Ser. No. 61/961,828 filed on Oct. 18, 2013, the entire content of which is expressly incorporated hereinto by reference.

FIELD

The embodiments disclosed herein relate generally to safety devices for electrical outlets. More specifically, the embodiments disclosed herein relate to devices whereby plugs associated with electrical appliances are positionally locked in an operative engaged relationship with an electrical outlet (e.g., so as to prevent removal of the plug and exposure of its associated receptacle).

BACKGROUND

Conventional electrical outlets present a known in-home hazard to children. In order to prevent potentially fatal accidental electrocution due to children inserting fingers or electrically conductive objects into an energized receptacle of the outlet, various safety device proposals intended to "child proof" electrical outlets have been advanced. One of the most common means of preventing accidental electrocution is to insert a so-called dummy plug into unused receptacles of the outlet. Such dummy plugs are usually a plate-like structure formed of an electrically insulating plastics material having a pair of protruding electrically insulating blades that may be inserted into and frictionally engaged with the contacts within the receptacle. See in this regard, U.S. Pat. No. 6,674,003 and Des, 151,571, the entire contents of which are expressly incorporated hereinto by reference.

While dummy plugs are useful to prevent accidental electrocution for receptacles of the outlet that are not being used to power an electrical appliance, there still exists the possibility that a child may physically remove a plug associated with an electrical appliance (e.g., by pulling on the cord to which the plug is operatively connected at its terminal end) from its engagement with a receptacle thereby exposing the receptacle (and its attendant danger) to the child.

What has been needed therefore are means by which the plug associated with an appliance cord may be securely positionally locked in its engaged position with a receptacle of an electrical outlet. It is towards providing such means that the embodiments disclosed herein are directed.

SUMMARY

In general, the embodiments disclosed herein are directed toward electrical outlet safety devices adapted for positionally capturing a plug head associated with an appliance cord relative to a receptacle of the outlet. Certain embodiments of the invention will include a body plate having front and rear sides and opposed lateral edges, the body plate being adapted for removable connection relative to a cover plate associated with the electrical outlet. At least one elongate open-ended blind channel will extend from one toward another of the opposed lateral edges. The channel thus defines an opposed pair of parallel edges to sandwich the plug head associated with the electrical appliance between the body plate and the cover plate of the electrical outlet, whereby the plug head is positionally captured relative to the receptacle.

The safety device may be embodied with a body plate having a generally E-shaped structure comprising upper and lower elongate open-ended blind channels each extending from one toward another of the opposed lateral edges. The rear side of the body plate may thus include upper and lower cavities co-located in alignment with the upper and lower channels, respectively.

Each of the cavities may be substantially rectangular. In certain embodiments, the cavities are asymmetrically positioned relative to horizontal centerlines of the upper and lower channels, respectively, in which case the cavities may have an upper portion which is smaller than a lower portion thereof. In use, the channels and cavities are adapted to positionally capture a plug head associated with an appliance cord relative to the receptacle of the outlet in which it is inserted.

The rear side of body plate may also include upper and lower recessed surfaces co-located with the upper and lower channels. Each of the upper and lower recessed surfaces may be arcuate. The depth of the upper and lower recessed surfaces may be less than the depth of the upper and lower cavities, respectively. In use, the co-located recessed arcuate surfaces are adapted to capture a conventional dummy plug if inserted into an unused one of the receptacles associated with the outlet.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

Figure 1:
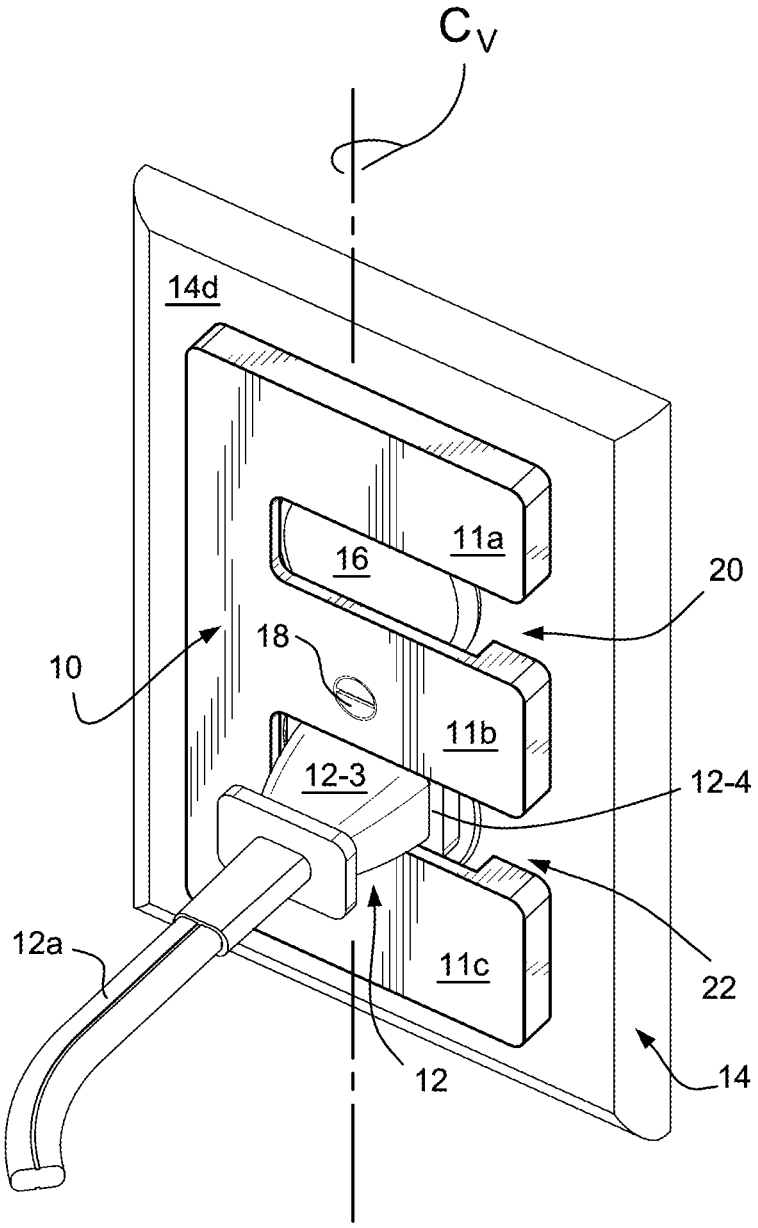
FIG. 1 is a perspective view showing an outlet safety device according to an embodiment of the invention described herein positioned in operative engagement with a plug associated with an electrical cord of an appliance inserted into a receptacle of an electrical outlet.
Figure 2:
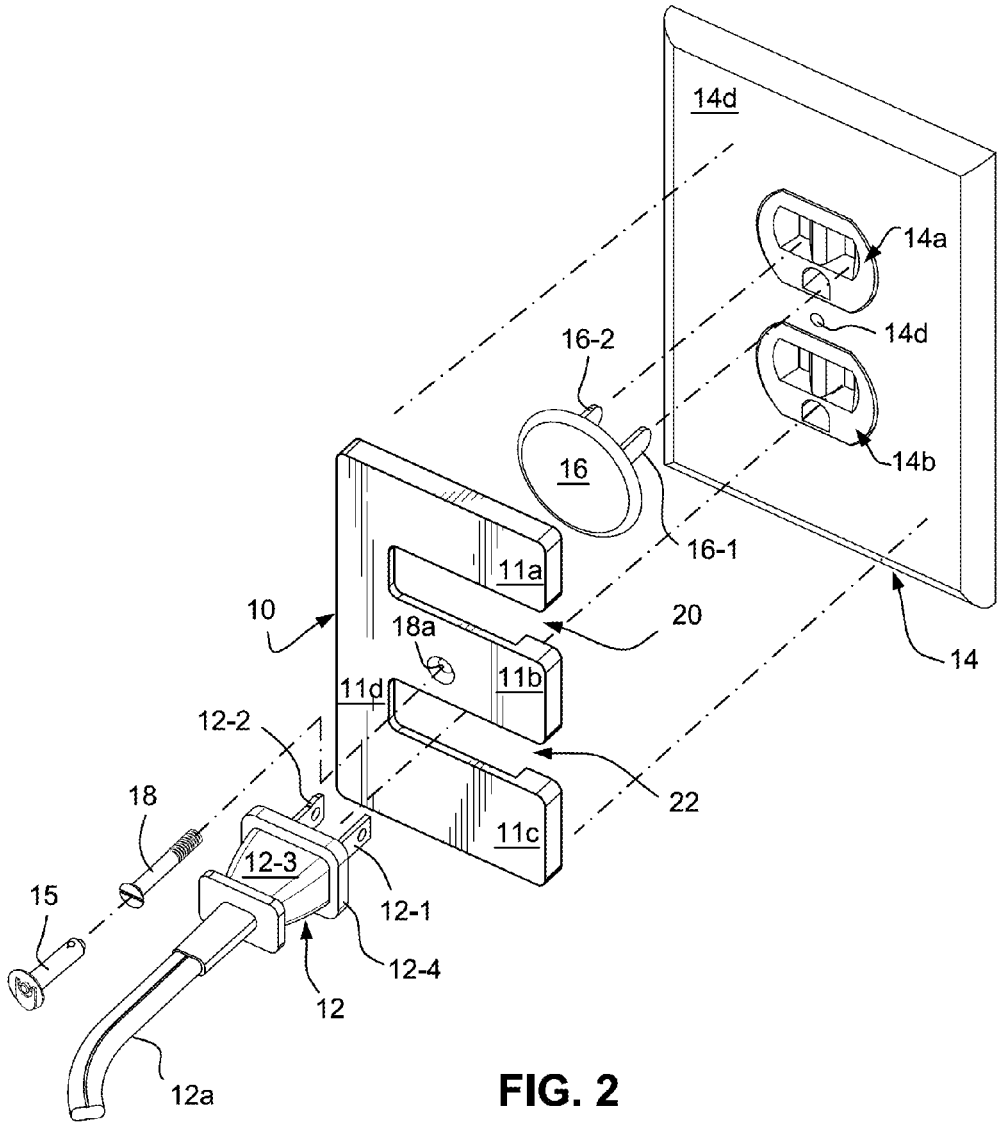
FIG. 2 is an exploded perspective view of the outlet safety device shown in FIG. 1.
Figure 3:
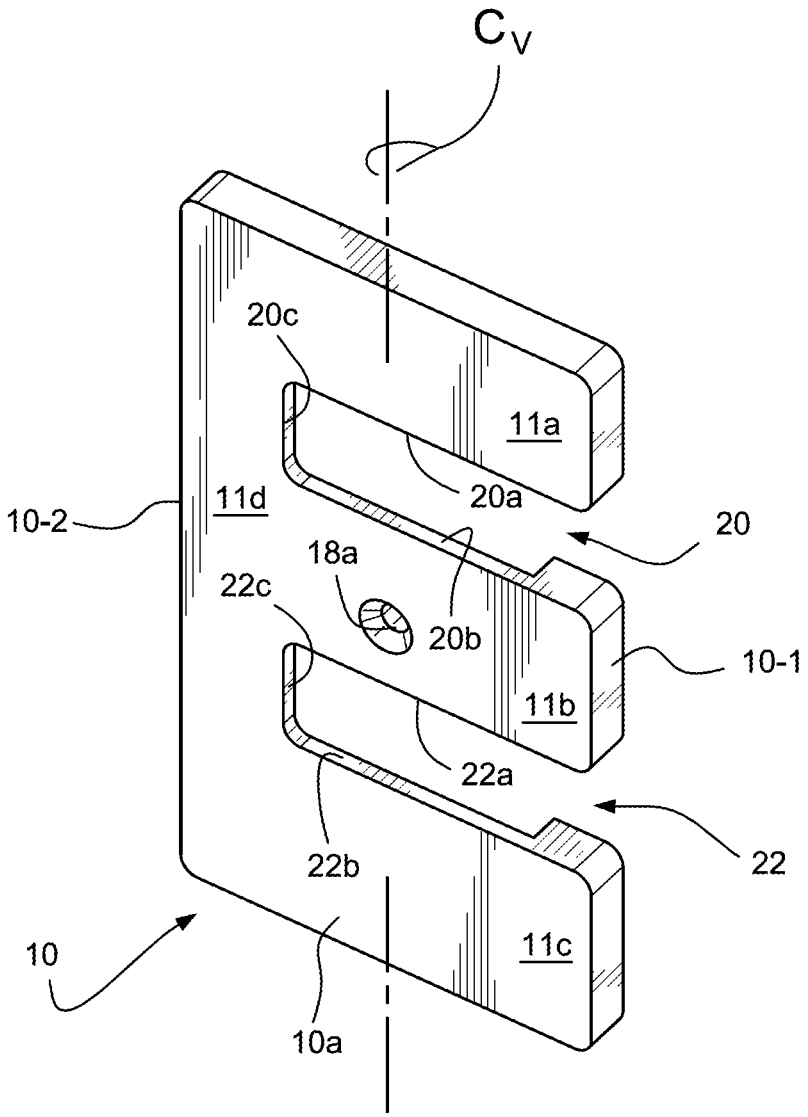
FIG. 3 is a front perspective view of an outlet safety device in accordance with an embodiment of the invention described herein.
Figure 4:
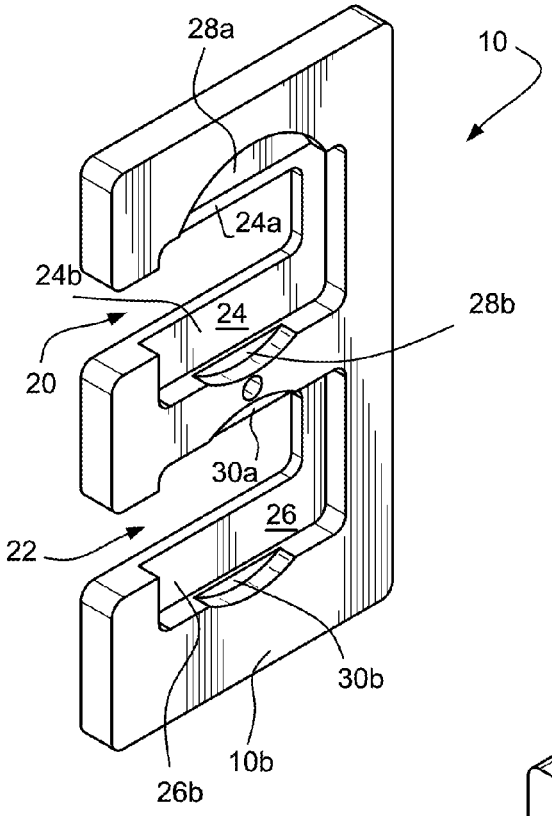
FIG. 4 is a left rear perspective view thereof.
Figure 5:
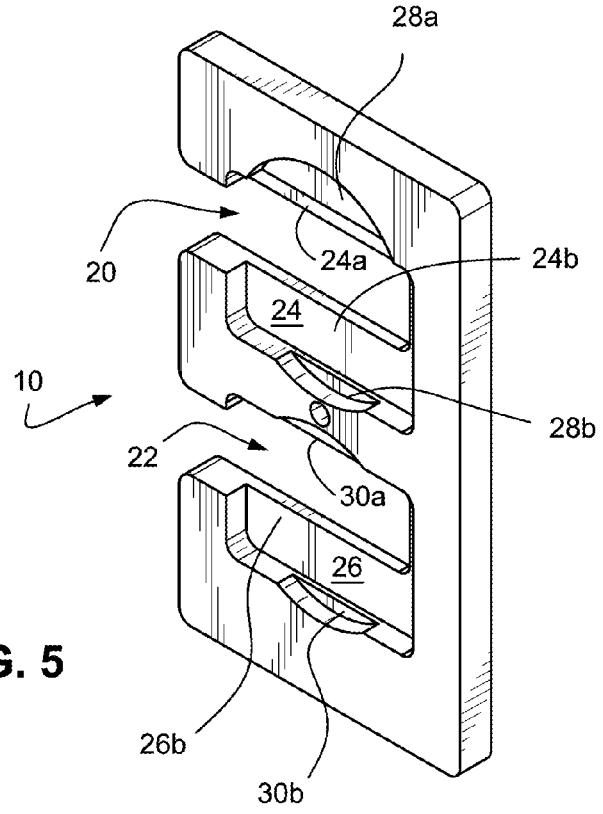
FIG. 5 is a right rear perspective view thereof.
Figure 6:
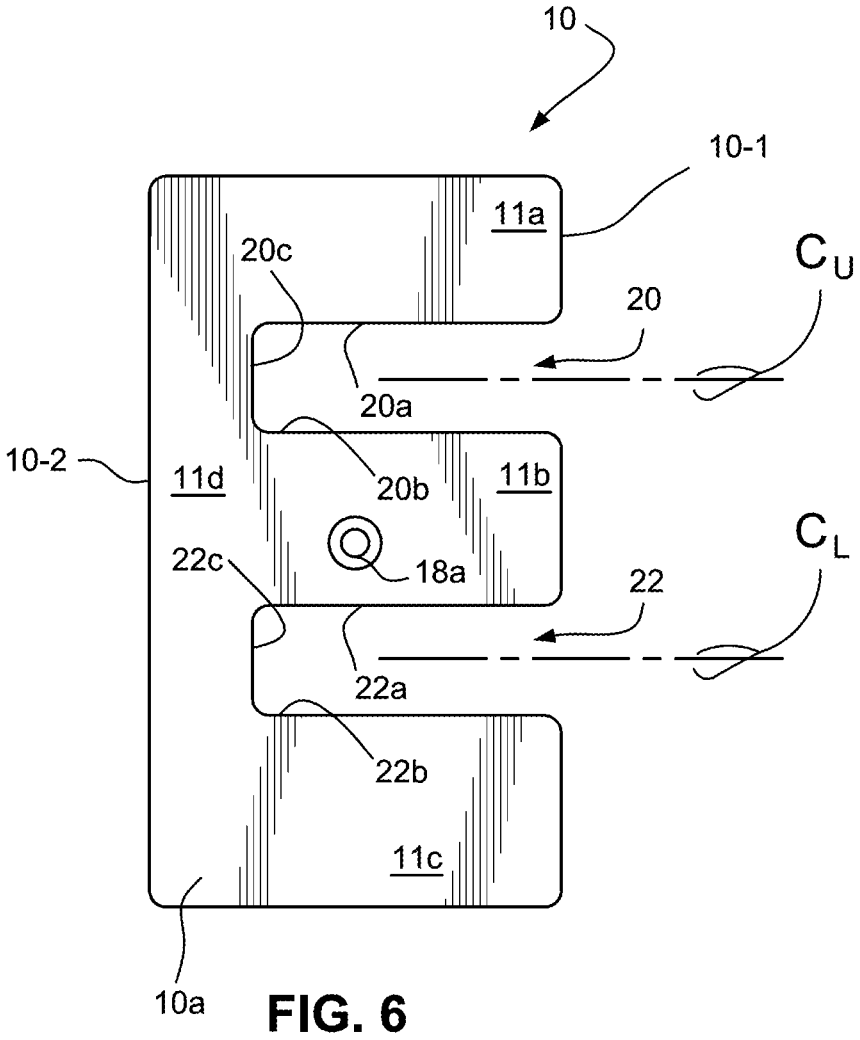
FIG. 6 is a front plan view thereof.
Figure 7:
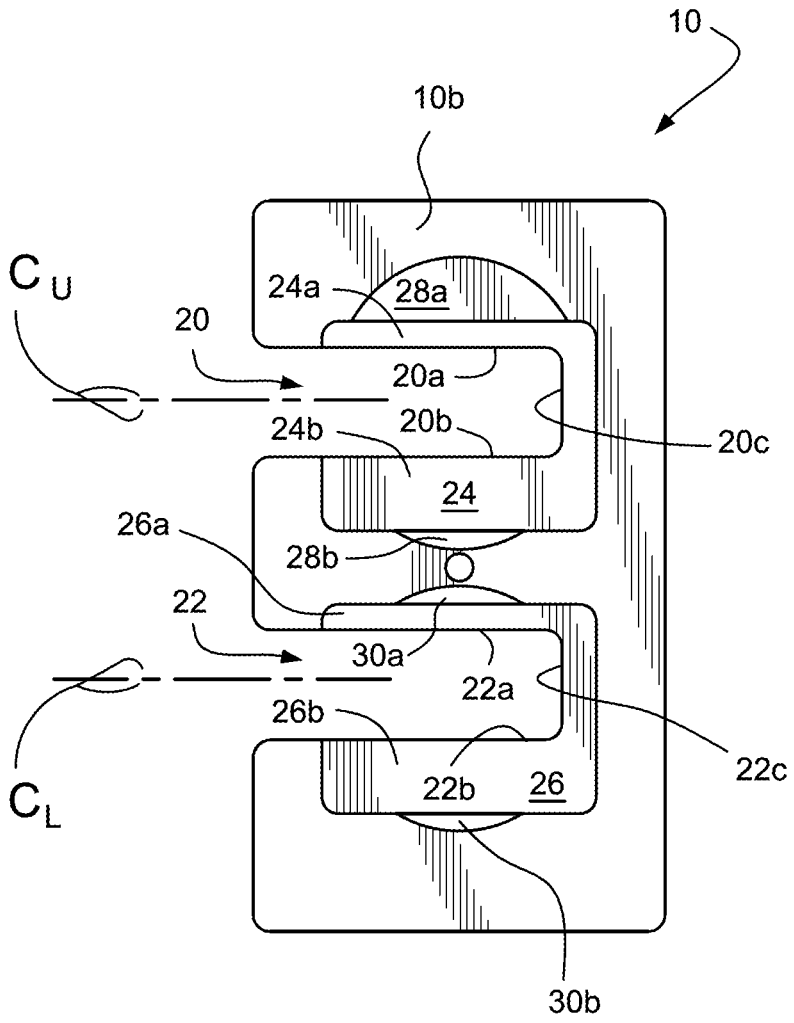
FIG. 7 is a rear plan view thereof.
Figure 8:
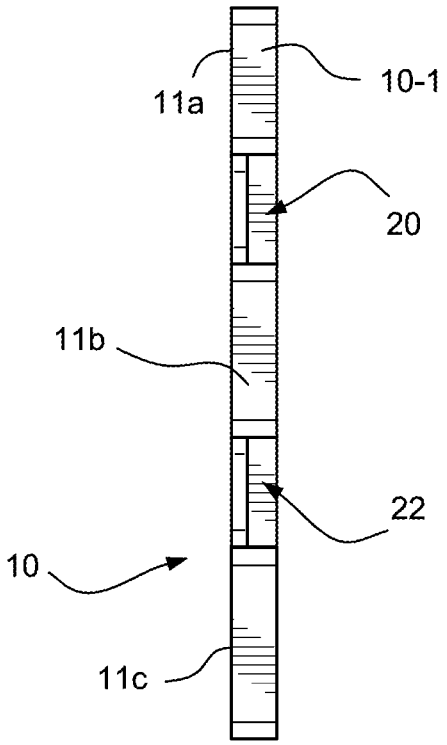
FIG. 8 is a right side elevational view thereof.
Figure 9:
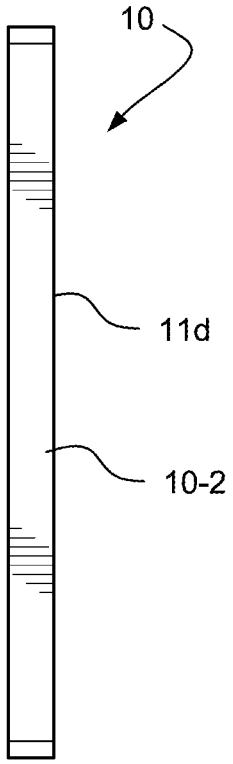
FIG. 9 is a left side elevational view thereof.
Figure 10:
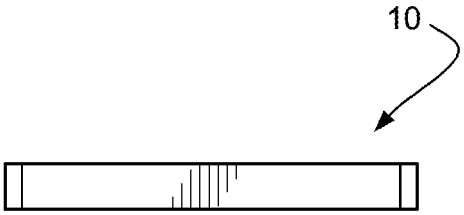
FIG. 10 is a bottom plan view thereof, the top plan view being substantially a mirror image thereof.

Accompanying FIGS. 1 and 2 depict assembled and exploded perspective views, respectively, showing an outlet safety device 10 according to an embodiment of the invention described herein positioned in operative engagement with a plug 12 associated with an electrical cord 12*a* of an appliance (not shown) inserted into a lower receptacle 14*b* of an electrical outlet 14. The plug 12 is of a conventional variety having a pair of outwardly protruding electrically conductive blades 12-1, 12-2 electrically connected to the electrical wiring associated with the cord 12*a*. The electrically conductive components of the plug 12 are housed within an electrically insulating plug head 12-3 typically formed of an elastomeric plastics material having a peripheral flange 12-4 providing a stop surface to prevent over insertion of the blades 12-1, 12-2 into the receptacle 14*b*. According to preferred embodiments, the plug 12 is an ungrounded two-blade power plug adapted for use with conventional NEMA (US National Electrical Manufacturers Association) receptacles, for example, NEMA 1, NEMA 2 and/or NEMA 5 receptacles.

The upper receptacle 14*a* of the electrical outlet 14 which is unoccupied by an appliance plug may be child-proofed by means of a conventional dummy plug 16 having dummy blades 16-1, 16-2 inserted therein.

As used herein, the term "appliance" is intended to reference any electrical device having an electrical cord with a male plug (i.e., having at least two protruding electrically conductive blades) that may be removably engaged with the corresponding slots associated with a conventional electrical receptacle. Thus, the term "appliance" is meant to refer to computers and computer peripheral equipment such as scanners, printers, and the like, lamps, televisions, radios, vacuum cleaners, clocks and the like.

The outlet safety device 10 is secured to the receptacle 14 by a threaded attachment screw 18 passing through an aperture 18*a* of the device 10 and a coaxially aligned aperture 14*c* associated with the receptacle cover plate 14*d* (see FIG. 2). The threaded attachment screw 18 is of sufficient length so as to engage with the internal threads of a conventional retaining aperture (not shown) associated with the receptacle 14 for the purpose of attaching the cover plate 14*d* securely thereto. Alternatively, however, a quick-release detent 15 may be provided in lieu of the screw 18 so allow the safety device 10 to be removed from the receptacle 14. Virtually any type of quick release detent 15 may be employed so as to frictionally engage the threaded aperture of the receptacle 14 yet be capable of being withdrawn therefrom.

As is perhaps better shown in FIGS. 6-10, the safety device 10 according to the embodiment depicted is generally an E-shaped plate-like body structure having substantially planar front and rear sides 10*a*, 10*b*, respectively. The safety device 10 is most preferably formed of a substantially rigid electrically insulating material (e.g., a thermoplastics material, fiberboard material or the like). Upper and lower parallel open-ended blind channels 20, 22 extending from one lateral side 10-1 toward an opposite lateral side 10-2 thereof. The channels 20, 22 are thereby defined by upper edges 20*a*, 22*a* opposed to lower parallel edges 20*b*, 22*b* and terminates beyond the vertical centerline ($C_V$) passing through the aperture 18*a* of the device 10 in substantially vertical interior edge 20*c*, 22*c*. The channels 20, 22 thereby define essentially upper, intermediate and lower finger projections 11*a*, 11*b* and 11*c* extending parallel to one another and connected to a lateral bridge member 11*d*.

The rear side 10*b* defines a pair of substantially rectangular cavities 24, 26 co-located in alignment with each of the channels 20, 22, respectively. As is shown, the cavities 24, 26 may be asymmetrically positioned in their lengthwise horizontal direction) relative to a horizontal centerline $C_U$, $C_L$ of the respectively associated blind channels 20, 22. In such a manner, therefore, upper portions 24*a*, 26*a* of each cavity 24, 26 are smaller than the respective lower portions 24*b*, 26*b* thereof (see FIG. 7).

In addition to the cavities 24, 26, the rear side 10*b* of the safety device 10 will likewise include co-located pairs of opposed arcuate recessed surfaces 28*a*, 28*b* and 30*a*, 30*b*, respectively. The recessed surfaces 28*a*, 28*b* and 30*a*, 30*b* circumscribe the generatrices of a circle having a center co-located with a respective centerline $C_U$, $C_L$ of its associated blind channel 20, 22. The circle circumscribed by the recessed surfaces 28*a*, 28*b* and 30*a*, 30*b* may be of substantially the same diameter or may be of a different diameter as compared to one another. In the embodiment shown in the accompanying FIGURES, the arcuate recessed surfaces 28*a*, 28*b* circumscribe a circle having a greater diameter as compared to the diameter of the circle circumscribed by recessed surfaces 30*a*, 30*b*. In such a manner, the recessed surfaces 28*a*, 28*b* and 30*a*, 30*b* may accept therein a correspondingly sized dummy plug 16. The depth of the recessed surfaces 28*a*, 28*b* is also preferably less than the depth of the cavities 24, 26 so that the latter provides a step-down surface relative to the former.

In use, the plug 12 associated with the appliance cord 12*a* may be plugged into one of the receptacles 14*a*, 14*b* associated with the electrical outlet 14 with the dummy plug 16 inserted into the other unused one of the receptacles 14*a*, 14*b*. As an example depicted in FIG. 1, the dummy plug 16 is inserted into the upper receptacle 14*a* while the plug 12 is inserted into the lower receptacle 14*b* of the outlet 14.

In order to positionally lock and secure the plug 12 relative to the receptacle 14*b*, the screw 18 is removed from the outlet 14. The safety device may then be positioned so that the flange 12-4 of the plug head 12-3 is received within the cavity 26 while the dummy plug 16 is received within the recessed surfaces 28*a*, 28*b*. Positioning of the safety device 10 may conveniently be accomplished by sliding the device 10 in a lateral direction (e.g., from left to right as viewed in FIG. 1) so that the plug head 12-3 is received within the blind channel 22. The opposed edges 20*a*, 20*b* and 22*a*, 22*b* will therefore overlap respective portions of the dummy plug 16 and the flange 12-4 of the plug head 12-3.

Once the safety device is positioned as described above, the screw 18 may be inserted through the aligned apertures 20 and 14*c* of the device 10 and cover plate 14*d*, respectively, and then threadably screwed into a secured position thereby securing the device 10 against the cover plate 14*d*. In some instances, a longer screw 18 than that which is conventionally provided with the outlet 14 may be required.

In such a manner, therefore, the flange 12-4 of the plug head 12-3 as well as the dummy plug 16 are sandwiched between the device 10 and the cover plate 14*d* thereby preventing removal from the receptacles 14*a*, 14*b*, respectively. If needed, a longer screw 18 may be inserted through the aligned apertures 20 and 14*c* of the device 10 and cover plate 14*d*, respectively, and then threadably screwed into a secured position. Alternatively, a quick-release detent 15 may be employed in lieu of the screw 18.

Figure 11:
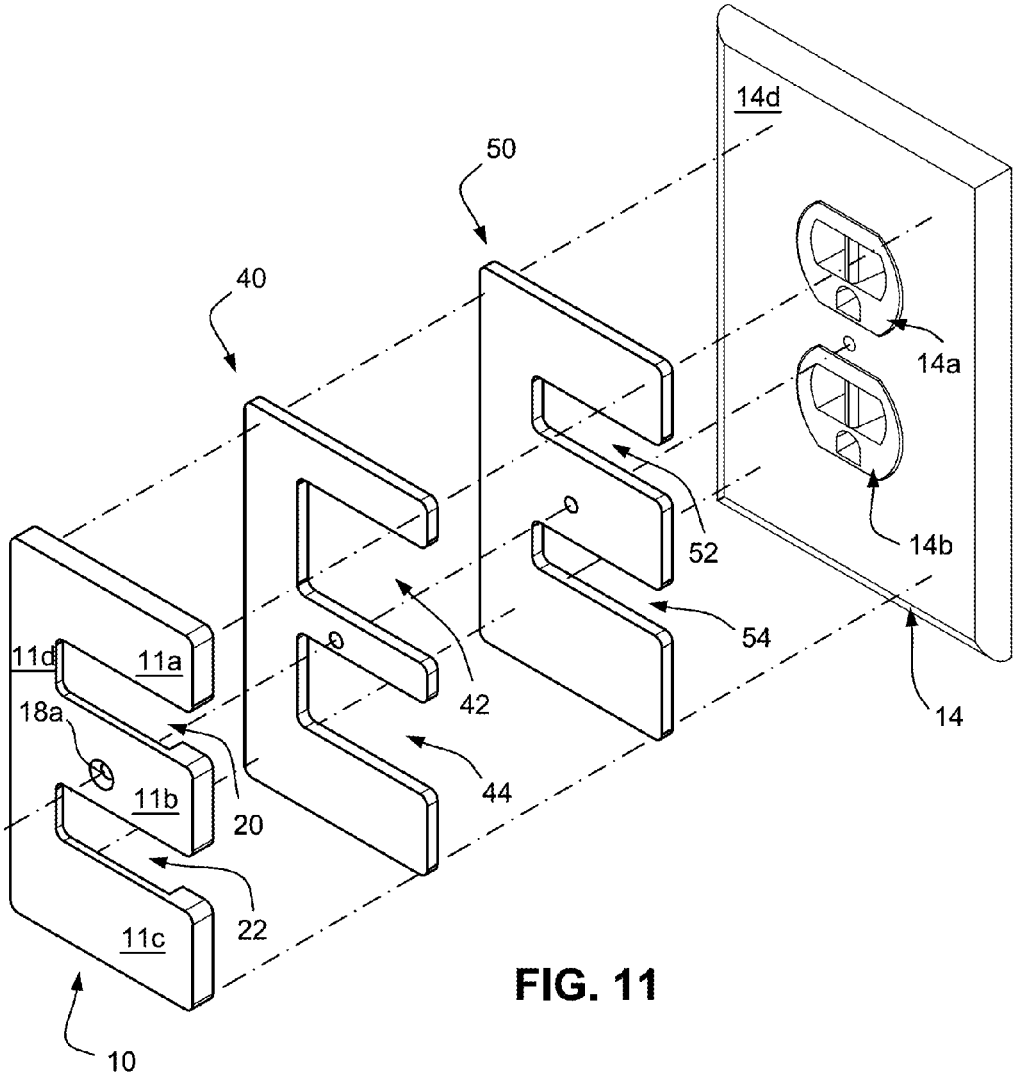
FIG. 11 is an exploded perspective view depicting another embodiment of an outlet safety device according to the invention described herein.

Accompanying FIG. 11 depicts the device 10 as described above being used in combination with adapter plates 40, 50, respectively. As shown, each of the adapter plates 40, 50 is a generally planar E-shaped plate formed of an electrically insulating material (e.g., a thermoplastics material, fiberboard material or the like). Each of the adapter plates has upper and lower elongate open-ended blind channels 42, 44 and 52, 54, respectively, extending from one toward another of the opposed lateral edges thereof. Each of the blind channels 42, 44 and 52, 54 is aligned with a respective one of the channels 20, 22 associated with the device 10.

As will be observed, the channels 42, 44 and 52, 54 of the exemplary adapter plates 40, 50, respectively, are sized differently as compared to one another and to the channels 20, 22 of the device 10. Thus, the widthwise dimensions of the channels 42, 44 and 52, 54 may be different as compared to one another and to the channels 20, 22. These varying dimensional attributes of the channels 42, 44 and 52, 54 of the adapter plates 40, 50 will thereby allow the device 10 to be adapted for capturing plug heads 12-3 of varying sizes and/or geometries in the manner as described above. Thus, one or both of the adapter plates 40, 50 may be stacked behind the device 10 and collectively secured to the outlet 14 in dependence on the particular size and/or geometry of the plug head 12-3 that is desired to be positionally secured. Although the adapter plates 40 and 50 have been depicted as separate structures, they could be provided as an integral ("universal") adapter plate as may be desired. Moreover, the adapter plates 40, 50 may be used with a device 10 as described above which is not provided with the cavities and recesses on the rear side 10*b* thereof (i.e., in which case the device 10 is a substantially planar E-shaped plate which is substantially flat on both the front and rear sides thereof).

It will be understood that the description provided herein is presently considered to be the most practical and preferred embodiments of the invention. Thus, the invention is not to be limited to the disclosed embodiments, but on the contrary, is intended to cover various modifications and equivalent arrangements included within the spirit and scope thereof.

What is claimed is:

1. An electrical outlet safety device adapted for positionally capturing a plug head associated with an appliance cord relative to at least one receptacle of an electrical outlet, wherein the safety device comprises:

a body plate having front and rear sides and opposed lateral edges, the body plate being adapted for removable connection relative to a cover plate associated with the electrical outlet;

at least one elongate open-ended blind channel extending from one toward another of the opposed lateral edges of the body plate, and at least one adapter plate having at least one elongate open-ended blind adapter channel extending from one toward another of the opposed lateral edges thereof, wherein the channel defines an opposed pair of parallel edges to sandwich the plug head associated with the electrical appliance between the body plate and the cover plate of the electrical outlet, whereby the plug head is positionally captured relative to the receptacle; and wherein the adapter plate is sized and configured to be placed against the rear side of the body plate such that the at least one adapter channel thereof is aligned with but differently sized as compared to the at least one channel of the body plate.

2. The safety device as in claim 1, wherein the body plate is a generally E-shaped structure comprising upper and lower elongate open-ended blind channels each extending from one toward another of the opposed lateral edges.

3. An electrical outlet comprising at least one receptacle, a cover plate for the at least one receptacle, and the safety device as in claim 1 removably connected to the outlet to positionally capture the plug head between the body plate and the cover plate.

4. The safety device as in claim 1, wherein the body plate includes a rear side having a cavity co-located in alignment with the at least one channel.

5. The safety device as in claim 4, wherein the cavity is substantially rectangular.

6. The safety device as in claim 5, wherein the cavity is asymmetrically positioned relative to a horizontal centerline of the at least one channel.

7. The safety device as in claim 6, wherein the cavity has upper and lower portions, wherein the upper portion is smaller than the lower portion.

8. The safety device as in claim 4, wherein the rear side of body plate includes a recessed surface co-located with the at least one channel and having a depth less than a depth of the cavity.

9. The safety device as in claim 8, wherein the recessed surface is arcuate.

10. The safety device as in claim 9, wherein the recessed surface defines generatrices of a circle having a center co-located with a horizontal centerline of the channel.

11. An electrical outlet safety device for positionally capturing a plug head associated with an appliance cord relative to a receptacle of the outlet, wherein the safety device comprises:

a body plate having front and rear sides and opposed lateral edges, the body plate being adapted for removable connection relative to a cover plate associated with the electrical outlet, wherein the body plate is a generally E-shaped structure comprising upper and lower elongate open-ended blind channels each extending from one toward another of the opposed lateral edges, and wherein the body plate includes a rear side having upper and lower cavities co-located in alignment with the upper and lower channels, respectively, and at least one generally E-shaped adapter plate comprising upper and lower elongate open-ended blind adapter channels each extending from one toward another of the opposed lateral edges of the adapter plate, wherein the at least one adapter plate is sized and configured to be placed against the rear side of the body plate such that the upper and lower adapter channels thereof are aligned with but differently sized as compared to the upper and lower channels of the body plate, respectively, to sandwich the plug head associated with the electrical appliance between the at least one adapter plate and the cover plate of the electrical outlet, whereby the plug head is positionally captured relative to the receptacle.

12. The safety device as in claim 11, comprising multiple said adapter plates, each having upper and lower adapter channels that are differently sized relative to one another and to the upper and lower channels of the body plate.

13. The electrical outlet as in claim 11, further comprising a quick-release detent for releasably connecting the body plate the outlet.

14. An electrical outlet comprising at least one receptacle, a cover plate for the at least one receptacle, and the safety device as in claim 11 removably connected to the outlet to positionally capture the plug head between the body plate and the cover plate.

15. The safety device as in claim 11, wherein each of the cavities is substantially rectangular.

16. The safety device as in claim 15, wherein each of the cavities is asymmetrically positioned relative to horizontal centerlines of the upper and lower channel, respectively.

17. The safety device as in claim 16, wherein each of the cavities has upper and lower portions, wherein the upper portion is smaller than the lower portion.

18. The safety device as in claim 11, wherein the rear side of body plate includes upper and lower recessed surfaces co-located with the upper and lower channels, wherein each of the upper and lower recessed surfaces has a depth which is less than a depth of the upper and lower cavities, respectively.

19. The safety device as in claim 18, wherein each of the upper and lower recessed surfaces is arcuate.

20. The safety device as in claim 19, wherein each of the upper and lower recessed surfaces defines generatrices of a circle having a center co-located with a horizontal centerline of the upper and lower channels, respectively.

21. The safety device as in claim 20, wherein the circles defined by the upper and lower recessed surfaces have substantially the same diameters.

22. The safety device as in claim 20, wherein the circles defined by the upper and lower recessed surfaces have different diameters.

* * * * *